US005857277A

United States Patent [19]

Mayze

[11] Patent Number: 5,857,277

[45] Date of Patent: Jan. 12, 1999

[54] PLAYTHINGS

[75] Inventor: Hedley John Mayze, Littleover, United Kingdom

[73] Assignee: Maylodge Limited, Manchester, United Kingdom

[21] Appl. No.: 727,647

[22] PCT Filed: Aug. 1, 1994

[86] PCT No.: PCT/GB94/01674

§ 371 Date: Oct. 15, 1996

§ 102(e) Date: Oct. 15, 1996

[87] PCT Pub. No.: WO95/29476

PCT Pub. Date: Nov. 2, 1995

[30] Foreign Application Priority Data

Apr. 23, 1994 [GB] United Kingdom ..... 9408115
May 23, 1994 [GB] United Kingdom ..... 9410203

[51] Int. Cl.[6] ..... G09F 13/24

[52] U.S. Cl. ..... 40/410; 40/409

[58] Field of Search ..... 40/409, 410

[56] References Cited

U.S. PATENT DOCUMENTS 2,587,620 3/1952 Hormann ..... 40/410
3,444,636 5/1969 Belokin, Jr. ..... 40/409
4,641,445 2/1987 Rossi .
4,817,311 4/1989 Ong .
5,313,727 5/1994 Murry, Jr. ..... 40/410
5,666,750 9/1997 Segan et al. ..... 40/410

FOREIGN PATENT DOCUMENTS 0444773 9/1991 European Pat. Off. .
0617395 9/1994 European Pat. Off. .

*Primary Examiner*—Cassandra H. Davis
*Attorney, Agent, or Firm*—Watts, Hoffmann, Fisher & Heinke Co., L.P.A.

[57] ABSTRACT

A plaything (10) comprises a display means (12) for displaying a desired scene (14). A particulate material (16) is provided on the display means (12). The plaything (10) further includes pick-up means (18) to pick-up at least some of said particulate material (16) at the bottom regions of the display means (12) and to deposit the picked up particulate material at the top region of the display means (12) to simulate falling snow. The plaything can be filled with a suitable fluid, for example, water. The plaything also includes drive means (28) for driving the pick-up means.

18 Claims, 4 Drawing Sheets

11
42
44
46
32
28
38
41
40
38
36
31
30
34
58
110
26
112
114
14
24
110
22
26
60
64
26B
112
12
62
64
60

26B
22
18
26B
26A
24
64
16
14
26A
III
III
11
12
62
A
26
26B
26A

PLAYTHINGS

This invention relates to playthings. More particularly, but not exclusively this invention relates to water filled decoration.

Water filled decorations are common and usually comprise a snow scene, for example a chalet similar to the sort that are found in Switzerland. The scene is provided inside a sealed casing which is, filled with water. The decoration also includes a white particulate material to simulate snow.

In order to simulate a snow storm, the decoration is lifted and then shaken, thereby agitating the particulate material. When the decoration is then replaced in its former position, the particulate material is seen to descend in a manner similar to falling snow.

It is a disadvantage of such decorations that they need to be shaken in order to simulate falling snow and, in order to view the falling snow continuously, once the particulate material has fallen, it is necessary to shake the decoration again.

It is an object of this invention to obviate and/or mitigate this disadvantage.

According to one aspect of this invention there is provided a plaything comprising a display means for displaying a desired scene, a particulate material in said display means, pick-up means for picking up at least some of the said particulate material at a first region of the display means and for depositing the picked up particulate material at a second region of the display means, and drive means for driving said pick-up means.

The pick-up means may comprise an annular member extending around the display means and having thereon a plurality of pick-up members each being capable of picking up some of the particulate material. Preferably, the annular member is substantially circular in configuration and may extend around the periphery of the display means.

Each pick-up member preferably has a profile so shaped to enable it to receive and pick up some of the particulate material, for example substantially L or C shaped. Preferably, each pick-up element extends from a rear region of the display means to a front region of the display means.

Conveniently, the annular member is arranged at the ⊥r region of the display means, whereby each pick-up member extends from said annular member to the front region of the pick-up means.

Preferably, the display means comprises a casing suitable for holding a fluid. The casing may comprise a transparent portion at the front thereof to enable the scene to be viewed. Means may be provided to prevent the operator viewing the pick-up means when viewing the scene through said front portion. Preferably, said means for preventing viewing comprises an annular screen extending between the rear and the front of the display means; the screen being preferably adapted to allow said particulate material to form therethrough. In the preferred embodiment, the screen comprises a plurality of concentric concave rings and support means for said rings, wherein said rings may be in the form of arms extending from the rear of the screen.

Advantageously, the plaything comprises a fluid, suitably water, held within the display means.

Preferably, said first region of the display means is a bottom region of the casing, and said second region of the display means is preferably a top region of the casing, such that the particulate material is picked up by the pick-up means at the bottom region of the casing, and is deposited at the top region of the casing. The particulate material being such that when the particulate material is deposited at the top region of the casing it decends to the bottom region of the casing to give the impression of a snow fall on said desired scene.

Preferably, the pick-up members are arranged substantially equi-spaced from each other around the annular member.

The drive means may comprise a suitable motor which may be electrical or wind-up. The motor may be connected via a gear arrangement to a rotary member capable of driving the pick-up means. It will be appreciated that the motor may be connected directly to the rotary member, thus obviating the need for a gear arrangement.

In a first embodiment of the invention, the rotary member may be mounted on a spigot extending rearwardly from the display means. The rotary member may be in the form of a radially outwardly extending elongate member extending outwardly from the spigot. The plaything may comprise a magnetic arrangement between said rotary member and said pick-up means to enable said rotary member to drive said pick-up means. The magnetic arrangement may comprise a magnet provided on the rotary member which may be attached to a bearing mounted on the spigot. Preferably, the magnetic arrangement further includes magnetic means on the pick-up means arranged in magnetic association with the magnet on the rotary member. Thus, it will be appreciated that, in the first embodiment, the plaything is operated by the motor which causes the rotary member to rotate about the spigot. In this embodiment, the magnetic association between the magnet on the rotary member and the magnetic means on the pick-up means causes the pick-up means to rotate with the rotary member.

In a second embodiment, the motor may be attached via a gear assembly, or directly, to a shaft which extends through a bore in a journal extending rearwardly from the display means. The shaft may extend into the display means and may be attached to a rotary element which is preferably substantially circular in configuration. The pick-up members are conveniently provided at the edge region of the rotary element. A sealing member may be provided between this journal and the shaft to ensure that there is no leakage of fluid from the display means.

Embodiments of the invention will now be described by way of example only with reference to the accompanying drawings, in which.

Figure 1:
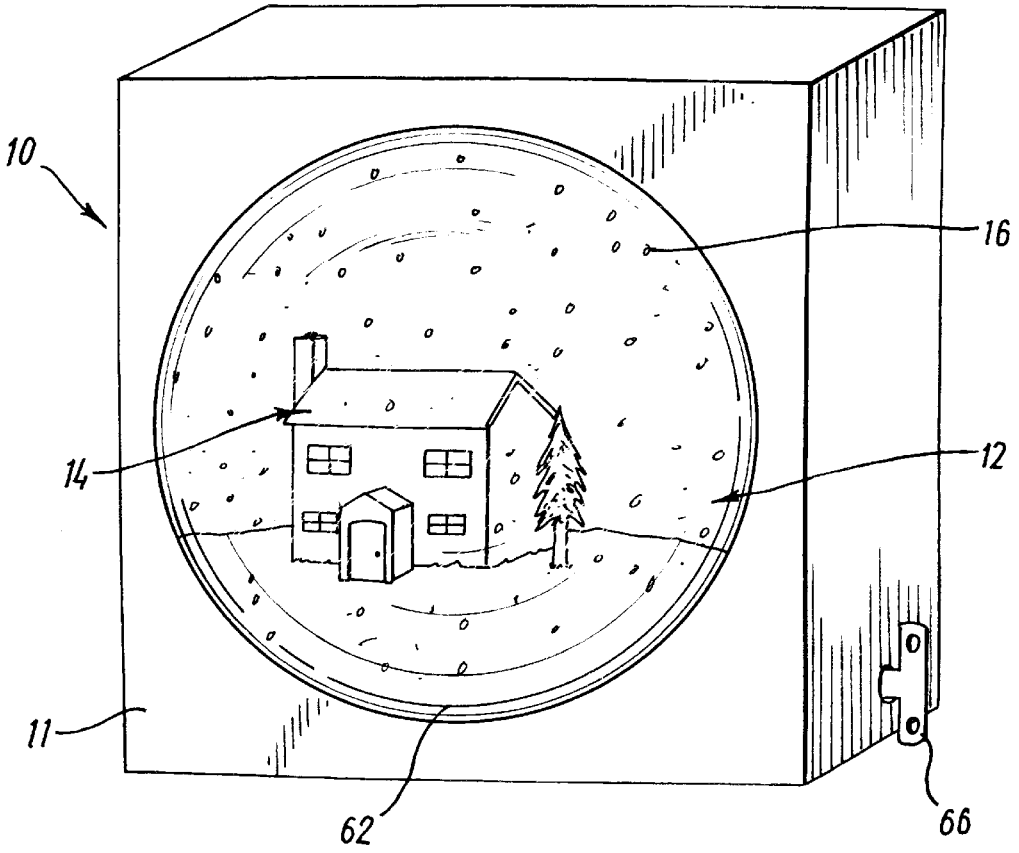
FIG. 1 shows a perspective view of a plaything.

Referring to the drawings, there is shown a plaything 10 comprising a housing 11, display means 12 which displays a scene 14, but it will be appreciated that scene 14 could be any suitable scene. In FIGS. 2 to 7 the housing 11 is represented by the dotted lines. A particulate material 16, which, in the embodiment shown is white, is provided in the display means 12 and is used to simulate falling snow as will be described below. Pick-up means 18 is arranged inside the display means 12 to pick-up the particulate material 16 at the bottom region of the display means 12 and deposit the particulate material 16 at the top region of the display means 12 to allow the particulate material 16 to descend slowly across a transparent panel at the front of the display means 12 as will be described below. The display means 12 is filled with a fluid, suitably water, to allow the particulate material 16 to descend slowly.

The display means comprises a sealed casino 22 which extends around the scene 14, thereby preventing leakage of any of the water inside the display means 12.

In the embodiment shown in FIGS. 2 to 5, the pick-up means comprises an annular member 24 which is provided at the rear of the display means 12. A plurality of pick-up members 26 are equi-spaced around the annular member 24. As can be seen from FIGS. 2 to 5, the annular member 24 extends around the peripheral region of the display means 12. Drive means 28, which will be described below, causes the pick-up means to rotate in the direction indicated by the arrow A in FIGS. 2 and 4.

Each pick-up member 26 comprises first and second elongate elements 26A,26B arranged substantially perpendicularly to each other to define an L or C shaped profile. It will be appreciated that the shape defined by the elongate element can be any suitable shape that is capable of receiving and picking up some of the particulate material; further examples of suitable shapes are V or U shapes. The pick-up members 26 are attached to the annular member 24 in such a fashion that on rotation of the annular member 24, each pick-up member 26 picks up some of the particulate material 16 at the bottom region of the display means 12 and carries the particulate material 16 which has been picked up to the top region of the display means 12 where the particulate material 16 is deposited to descend to the bottom region of the display means 12 thereby creating the effect of a snow fall on the scene 14.

Figure 3:
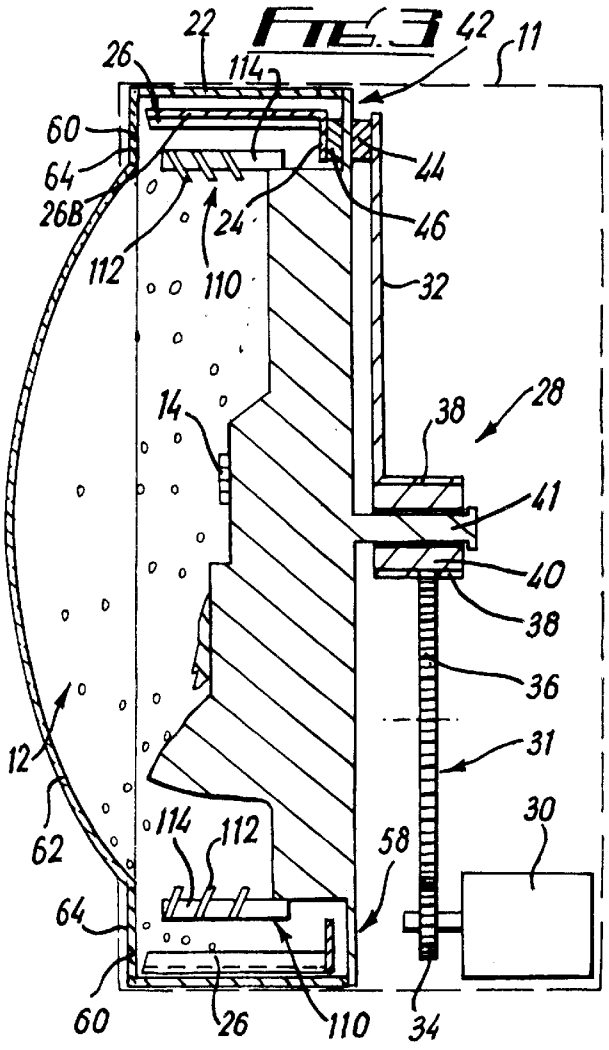
FIG. 3 shows a view along the lines III—III in FIG. 2 2.
Figure 2:
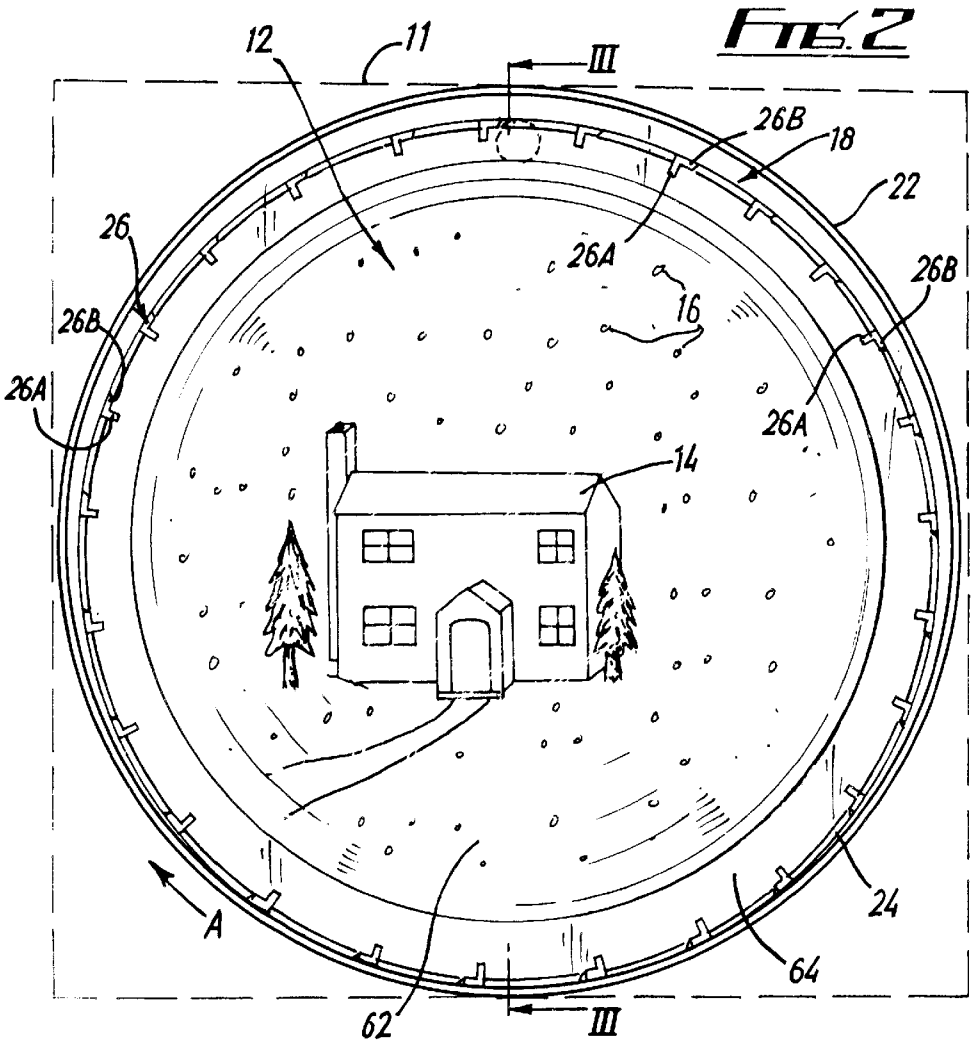
FIG. 2 shows a front view of a plaything shown in FIG. 1.

Referring to FIGS. 2 and 3, the drive means 28 comprises a motor 30 which can be a wind-up motor or an electrical motor. The motor 30 is attached via a gear arrangement 31 to a rotary member in the form of a rotor 32. The gear arrangement 31 comprises a first cog 34 in meshing engagement with a second cog 36 which, in turn, is in meshing engagement with teeth 38 on a bearing 40 mounted on a spigot 41. The rotor 32 extends from the bearing 40 radially outwardly to the peripheral region of the display means whereby the end of the rotor 32 remote from the bearing 40 is adjacent the pick-up member.

A magnetic arrangement 42 is provided between the rotor 33 and the annular member 24, whereby upon rotation of the rotor 32 driven by the motor 30, the magnetic arrangement 42 causes the annular member 24 to rotate with the rotor 32.

In the embodiments shown in FIGS. 2 to 5 the magnetic arrangement 42 comprises a first magnet 44 mounted an the end of the rotor 32, and a second magnet 46 mounted on the annular member 24. It will be appreciated that the magnetic arrangement 44 may be any other suitable arrangement, for example the magnet 44 or the magnet 46 could be replaced by steel or other materials susceptible to magnetic forces.

Figure 5:
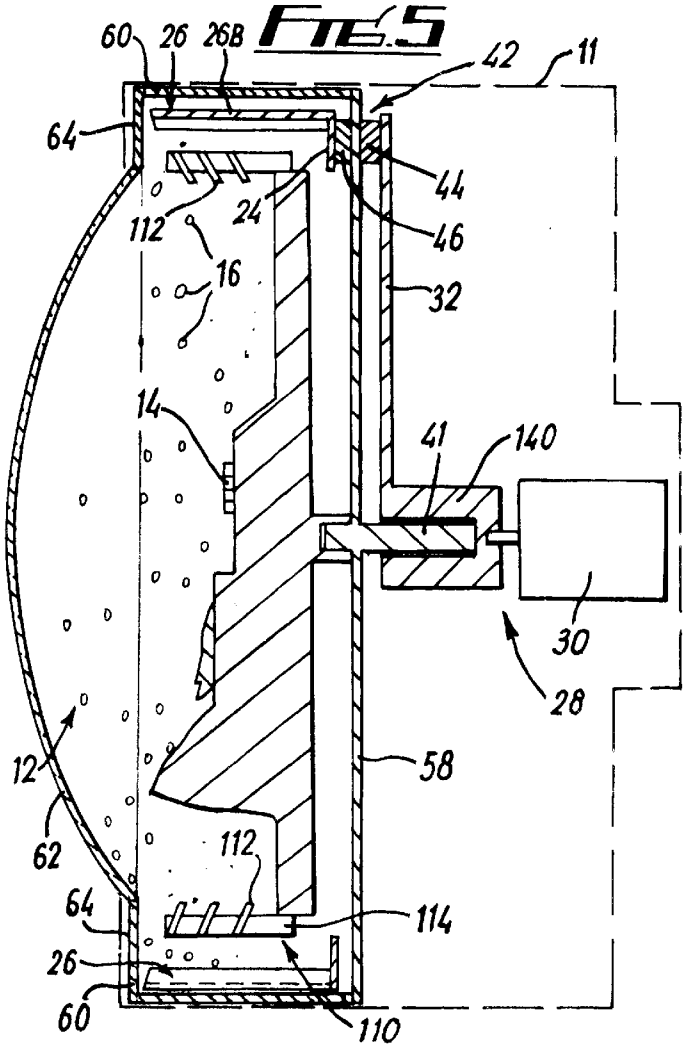
FIG. 5 shows a view along the line is V—V of FIG. 4.
Figure 4:
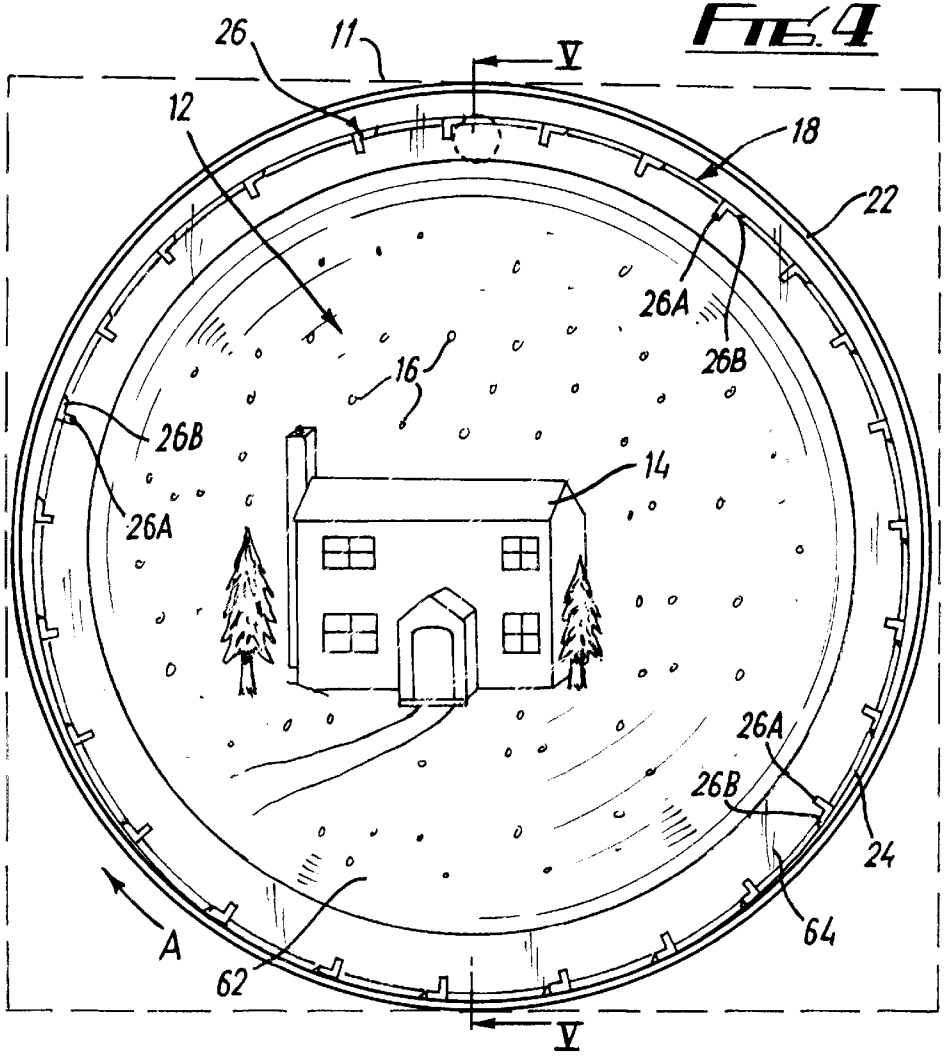
FIG. 4 shows a front view of a second embodiment.

The embodiment shown in FIGS. 4 and 5 is similar to the embodiment shown in FIGS. 2 and 3 with the exception that the motor 30 engages directly a beating 140 whereby the gear arrangement is omitted. Features in FIGS. 4 and 5 which are the same as those in FIGS. 2, and 3 have been designated with the same reference numeral. The bearing 140 is similar to the bearing mounted on the spigot 41 extending rearwardly from the rear of the casing 22, but in the embodiment shown in FIGS. 4 and 5 the spigot 41 does not extend completely through the bearing 140.

Figure 7:
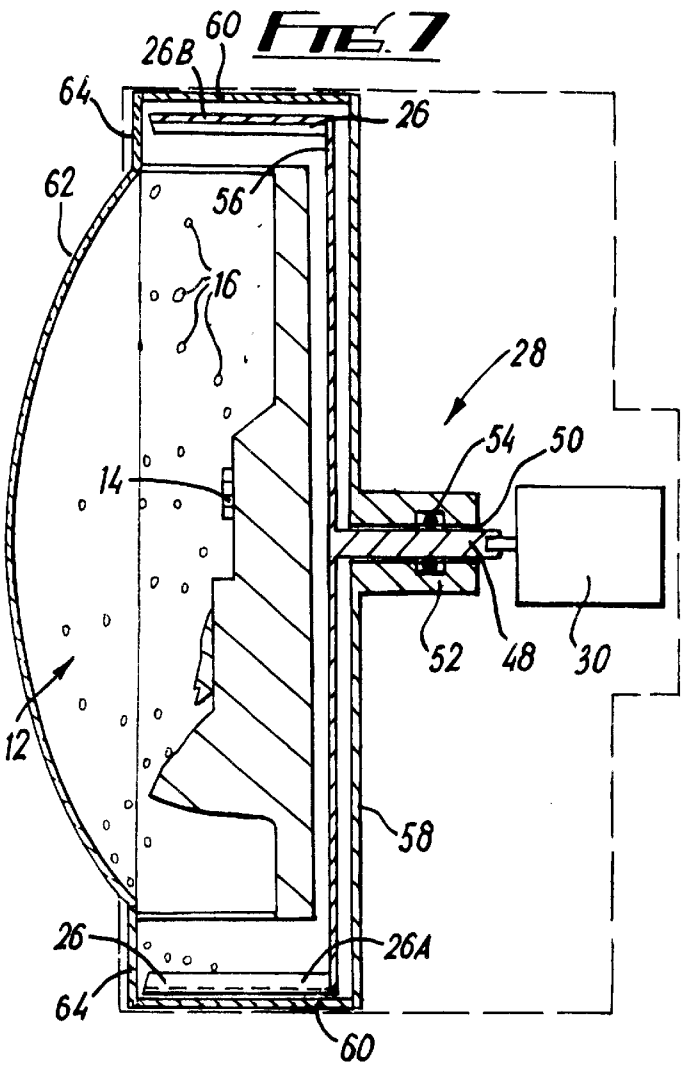
FIG. 7 shows a view along the lines VII—VII in FIG. 6.
Figure 6:
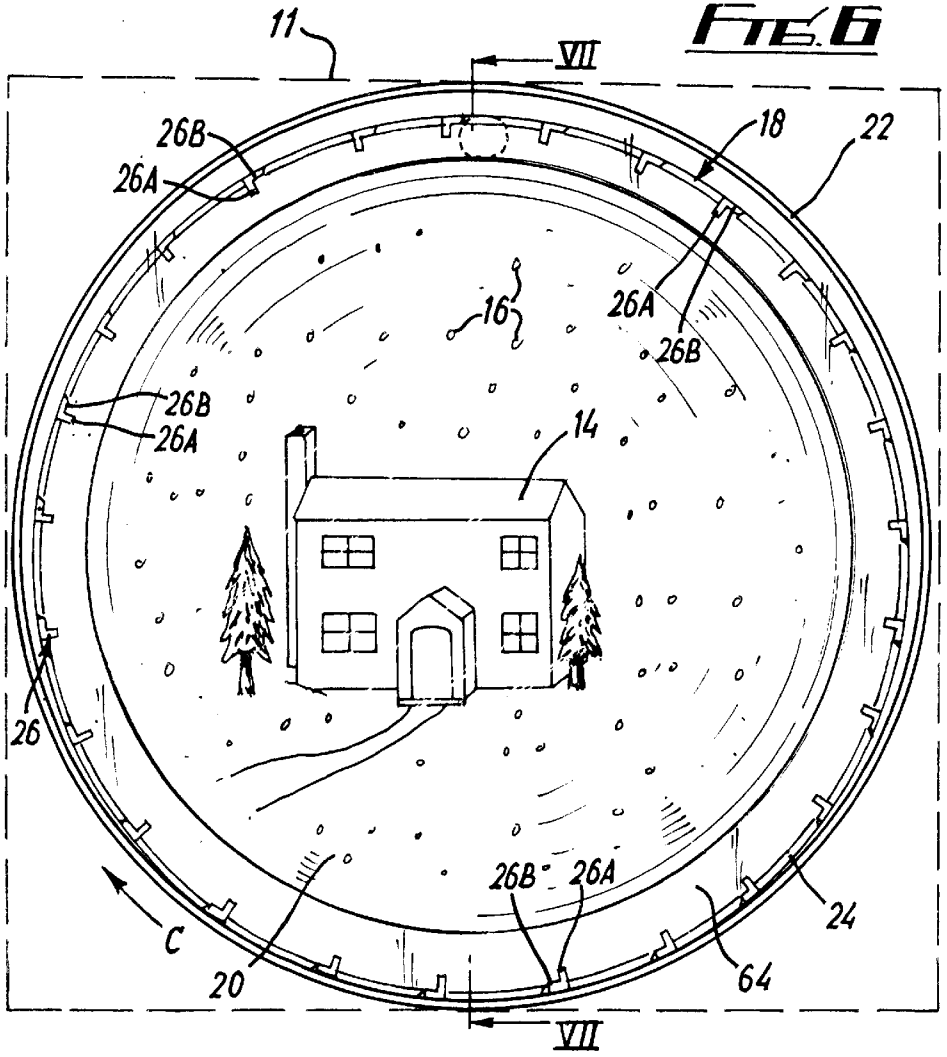
FIG. 6 shows a front view of a third embodiment.

Referring to FIGS. 6 and 7, there is shown an alternative arrangement for the drive means and the pick-up means 18. In this embodiment, the motor 30 is directly attached to a shaft 48 extending through a bore 50 in a journal 52. The journal 52 extends rearwardly from the display means 12 and is provides with a sealing member 54, suitably an O-ring, to prevent leakage of water in the display means 12.

In this embodiment, a rotary element 56 is connected to the shaft 48 and is provided at its periphery with pick-up members 26 identical to the pick-up members 26 shown in FIGS. 2 to 5. Thus, this arrangement avoids the need for a magnetic arrangement 42. In operation, the motor 30 drives the shaft 48 which in turn drives the rotary element 56 in the direction indicated by the arrow C to pick-up and deposit particulate material 16 in the same way as the embodiment shown in FIGS. 2 to 5.

A casing 58 is provided around the display means 12 inside the housing 11. The casing 58 may comprise an opaque portion 60 and a transparent portion 62. The opaque portion 60 extends around the sides of the display means 12 and across the peripheral region 64 of the front of the display means 12 to hide from views the pick-up means 18. The transparent portion 62 of the casing 58 is convex as shown in FIGS. 3,5 and 7 of the drawings to allow the scene to be viewed.

The housing 11 is provided with an aperture through which the transparent portion 62 may extend. It will be appreciated that, because the opaque portion 60 is hidden from view by the housing 11, it need not be opaque but can be transparent i.e. the same as the transparent portion 62.

Suitable means in the form of a screen 110 can be provided, and is shown in FIGS. 3 and 5 to prevent the pick-up means 18 being viewed via the transparent portion. The screen 110 comprises a plurality of concentric concave rings 112 supported by equispaced arms 114 which extend from the rear of the scone 14. The concentric rings 112 are so arranged to prevent viewing of the pick-up means but to allow the particulate material to fall between adjacent rings 112.

The motor 30 can be an electric motor or a wind-up clockwork motor. In the case of an electric motor, it is envisaged that a suitable holder for batteries will be provided to provide power for the motor. In the case of a wind up motor, appropriate key 66 will be provided at the rear or at the side (see FIG. 10) of the housing 11 to allow the motor 30 to be wound up. If desired, the motor can be similar to the motors which are used in musical boxes to play a tune.

Various modifications can be made without departing from the scope of the invention, for example, the scene 14 can be any desired scene, and the particulate material can be desired similate falling leaves or confetti. Also, the transparent region can be of any desired shape.

Whilst endeavouring in the foregoing specification to draw attention to those features of the invention believed to be of particular importance it should be understood that the Applicant claims protection in respect of any patentable feature or combination of features hereinbefore referred to and/on shown in the drawings whether or not particular emphasis has been placed thereon.

I claim:

1. A plaything comprising a display means for displaying a desired scene, wherein the display means comprises:

a fixed casting;

a liquid held in said casing;

a particulate material in said casing;

pick-up means in said casing for picking up at least some of said particulate material at a first region of the display means and for deposit of the picked up particulate material at a second region of the display means;

a rotary shaft having at least a portion within the casing for rotation relative to the casing, the pick-up means being mounted on the shaft wherein the pick-up means can be rotated by the shaft relative to the casing;

drive means connected to the shaft for driving the pick-up means; and, wherein said first region of the display means is a bottom region of the casing, and said second region of the display means is a top region of the casing.

2. A plaything according to claim 1 wherein the pick-up means comprises an annular member extending around the display means and having thereon a plurality of pick-up members each being capable of picking up some of the particulate material.

3. A plaything according to claim 2 wherein the annular member is arranged at a rear region of the display means, whereby each pick-up member extends from said annular member to a front region of the pick-up means.

4. A plaything according to claim 2, wherein the shaft extends through a bore in a journal extending rearwardly from the casing.

5. A plaything according to claim 1 wherein the drive means comprises a motor.

6. A plaything according to claim 5 wherein the motor is a selected one of an electrical and a wind-up.

7. A plaything according to claim 1, wherein the casing has a front including a transparent portion to enable the scene to be viewed.

8. A plaything comprising a display means for displaying a desired scene, a particulate material in said display means, pick-up means for picking up at least some of the said particulate material at a first region of the display means and for depositing the picked up particulate material at a second region of the display means, and drive means for driving said pick-up means, wherein the pick-up means has thereon a plurality of pick-up members each being capable of picking up some of the particulate material, each pick-up member having a profile shaped to enable it to receive and pick-up some of the particulate material, and each pick-up member comprising first and second elongate pick-up elements defining said profile, each pick-up element extending from a rear region of the display means to a front region of the display means.

9. A plaything according to claim 8, wherein the pick-up means includes an annular member extending around the display means.

10. A plaything according to claim 8, wherein the pick-up members are arranged substantially equi-spaced from each other around the annular member.

11. A plaything according to claim 8, wherein the display means includes a casing suitable for holding a liquid, the casing having a transparent portion at a front thereof to enable the scene to be viewed.

12. A plaything according to claim 8, further comprising a liquid held within the display means.

13. A plaything according to claim 8, wherein the drive means includes a motor.

14. A plaything according to claim 13, wherein the motor is a selected one of an electrical motor and a wind-up motor.

15. A plaything according to claim 13, wherein the motor is connected via a gear arrangement to a rotary member for driving the pick-up means.

16. A plaything according to claim 13, wherein the motor is connected to the pick-up means attached via a selected one of a gear assembly and directly to a shaft extending through a bore in a journal extending rearwardly from the display means.

17. A plaything according to claim 13, wherein the motor includes an output shaft and the shaft extends into the display means and is attached to a rotary element, the rotary element being substantially circular in configuration.

18. A plaything according to claim 8, wherein the drive means includes a rotary member mounted on a spigot extending rearwardly from the display means, the rotary member being a radially outwardly extending elongate member extending outwardly from the spigot.

* * * * *